US007388961B2

(12) United States Patent
Shennib et al.

(10) Patent No.: US 7,388,961 B2
(45) Date of Patent: Jun. 17, 2008

(54) REMOVAL TOOL AND METHOD FOR EXTENDED WEAR CANAL DEVICES

(75) Inventors: Adnan Shennib, Fremont, CA (US); Gregory Kushner, El Sobrante, CA (US); Richard Carl Urso, Redwood City, CA (US); Ralph Patrick Contioso, Alviso, CA (US)

(73) Assignee: Insound Medical, Inc., Newark, CA (US)

( * ) Notice: Subject to any disclaimer, the term of this patent is extended or adjusted under 35 U.S.C. 154(b) by 620 days.

(21) Appl. No.: 11/053,174

(22) Filed: Feb. 7, 2005

(65) Prior Publication Data

US 2005/0249370 A1 Nov. 10, 2005

Related U.S. Application Data

(60) Provisional application No. 60/542,773, filed on Feb. 6, 2004, provisional application No. 60/542,776, filed on Feb. 5, 2004.

(51) Int. Cl.
*H04R 25/00* (2006.01)

(52) U.S. Cl. ..... 381/329; 381/328; 381/322; 181/135

(58) Field of Classification Search ..... 381/312, 381/322, 326, 328, 329; 181/129, 130, 135; 600/25; 607/56, 57; 606/162
See application file for complete search history.

(56) References Cited

U.S. PATENT DOCUMENTS 4,817,609 A * 4/1989 Perkins et al. ..... 381/328

* cited by examiner

*Primary Examiner*—Brian Ensey
(74) *Attorney, Agent, or Firm*—Townsend and Townsend and Crew LLP

(57) ABSTRACT

Embodiments of the invention provide a removal tool for atraumatically removing a hearing device inserted deeply in the ear canal of a user. The removal tool comprises a shaft adapted to be grasp in the hand and a plurality of hooks or other attachment elements coupled to a first end of the shaft. The hooks have a shape and orientation configured to minimize injurious contact with the walls of the ear canal when the removal tool is inserted into the ear canal. The hooks are also configured to detachably engage a loop structure or other attachment system of the hearing device for removal of the device independent of a radial orientation of the shaft with respect to the hearing device. The hooks can also be configured to engage the loop structure in two or more planes for removal of the hearing device. Also, the hooks can be configured to engage the loop structure so as to exert minimal axial force on the hearing device in a medial direction.

47 Claims, 6 Drawing Sheets

REMOVAL TOOL AND METHOD FOR EXTENDED WEAR CANAL DEVICES

CROSS-REFERENCES TO RELATED APPLICATIONS

This application claims the benefit of priority of U.S. Provisional Application Ser. Nos.: 60/542,773, filed on Feb. 6, 2004 and 60/542,776, filed on Feb. 5, 2004, to full disclosure of both of which is incorporated herein by reference. The application is related to the following: commonly-assigned patent U.S. Pat. No. 6,473,513 issued Oct. 29, 2002; commonly-assigned and applications for patent: U.S. patent application Ser. No. 09/199,669 filed Nov. 25, 1998 (now U.S. Pat. No. 6,940,988) U.S. patent application Ser. No. 11/044,993 filed Jan. 26, 2005; U.S. patent application Ser. No. 11/053,656 filed Feb. 7, 2005; and U.S. patent application Ser. No. 11/058,097 filed Feb. 14, 2005.

BACKGROUND OF THE INVENTION

Field of the Invention

Embodiments of the present invention relate to a tool and method for the removal of hearing devices that are worn at least partially in the ear canal. More specifically, embodiments of the invention relate to a tool and a method for removal of a completely in the canal hearing device including devices positioned deep in the canal.

Since embodiments of the invention relate to removal of a hearing device from the ear canal, a brief description of the anatomy of the ear canal will now be presented for purposes of illustration. While the shape and structure, or morphology, of the ear canal can vary from person to person, certain characteristics are common to all individuals. Referring now to FIGS. 1-2, the external acoustic meatus (ear canal) is generally narrow and contoured as shown in the coronal view in FIG. 1. The ear canal 10 is approximately 25 mm in length from the canal aperture 17 to the center of the tympanic membrane 18 (eardrum). The lateral part (away from the tympanic membrane) of the ear canal, a cartilaginous region 11, is relatively soft due to the underlying cartilaginous tissue. The cartilaginous region 11 of the ear canal 10 deforms and moves in response to the mandibular (jaw) motions, which occur during talking, yawning, chewing, etc. The medial (towards the tympanic membrane) part, a bony region 13 proximal to the tympanic membrane, is rigid due to the underlying bony tissue. The skin 14 in the bony region 13 is thin (relative to the skin 16 in the cartilaginous region) and is more sensitive to touch or pressure. There is a characteristic bend 15 that roughly occurs at the bony-cartilaginous junction 19 (referred to herein as the bony junction), which separates the cartilaginous 11 and the bony regions 13. The magnitude of this bend varies among individuals.

The ear canal 10 terminates medially with the tympanic membrane 18. Laterally and external to the ear canal is the concha cavity 2 and the auricle 3, both also cartilaginous. The junction between the concha cavity 2 and the cartilaginous part 11 of the ear canal at the aperture 17 is also defined by a characteristic bend 12 known as the first bend of the ear canal. Hair 5 and debris 4 in the ear canal are primarily present in the cartilaginous region 11. Physiologic debris includes cerumen (earwax), sweat, decayed hair, and oils produced by the various glands underneath the skin in the cartilaginous region. Non-physiologic debris consists primarily of environmental particles that enter the ear canal. Canal debris is naturally extruded to the outside of the ear by the process of lateral epithelial cell migration (see e.g., Ballachanda, The Human ear Canal, Singular Publishing, 1995, pp. 195). There is no cerumen production or hair in the bony part of the ear canal.

A cross-sectional view of the typical ear canal 10 (FIG. 2) reveals generally an oval shape and pointed inferiorly (lower side). The long diameter ($D_L$) is along the vertical axis and the short diameter ($D_S$) is along the horizontal axis. These dimensions vary among individuals.

First generation hearing devices were primarily of the Behind-The-Ear (BTE) type. However they have been largely replaced by In-The-Canal (ITC) hearing devices are of which there are three types. In-The-Ear (ITE) devices rest primarily in the concha of the ear and have the disadvantages of being fairly conspicuous to a bystander and relatively bulky to wear. Smaller ITC devices fit partially in the concha and partially in the ear canal and are less visible but still leave a substantial portion of the hearing device exposed.

Recently, Completely-In-The-Canal (CIC) hearing devices have come into greater use. These devices fit deep within the ear canal and can be essentially hidden from view from the outside. In addition to the obvious cosmetic advantages, CIC hearing devices provide, they also have several performance advantages that larger, externally mounted devices do not offer. Placing the hearing device deep within the ear canal and proximate to the tympanic membrane (ear drum) improves the frequency response of the device, reduces distortion due to jaw extrusion, reduces the occurrence of the occlusion effect and improves overall sound fidelity.

However, despite their advantages, CIC hearing devices, particularly those positioned deep in the ear, are not as readily accessible by the user as are conventional ITC devices. A simple and effective method is therefore desirable for the removal of these devices, particularly when professional help—such as an ear, nose and throat specialist (ENT) or an audiologist—and/or specialized equipment—such as a scope microscope—are not readily available.

BRIEF SUMMARY OF THE INVENTION

Various embodiments of the invention provide systems, tools and methods for removing a hearing aid or other hearing device from the ear of the user including CIC hearing aids inserted deeply in the ear canal. Also, embodiments allow the hearing device to be removed by the user or by another person (e.g. a doctor or audiologist). Further, embodiments allow the hearing device to be removed with minimal dexterity by the user and without visualization of either the ear or the tool by the user.

One embodiment provides a removal tool for atraumatically removing a hearing device inserted deeply in the ear canal of a user. The removal tool comprises a shaft adapted to be grasp in the hand and a plurality of hooks or other attachment elements coupled to a first end of the shaft. The hooks have a shape and orientation configured to minimize injurious contact with the walls of the ear canal when the removal tool is inserted into the ear canal. The hooks are also configured to detachably engage a loop structure or other attachment system of the hearing device for removal of the device independent of a radial orientation of the shaft with respect to the hearing device. The hooks can also be configured to engage the loop structure in two or more planes for removal of the hearing device. Further, the hooks can be configured to engage the loop structure so as to exert minimal axial force on the hearing device in a medial direction. Desirably, this force causes no or only minimal displacement of the hearing device in the medial direction. This is desirable to prevent the hearing device from inadvertently being pushed against the tympanic membrane.

In various embodiments, the hooks can have a variety of configurations and orientations to minimize injury or irritation to the ear canal as well as to facilitate removal of the hearing aid. In many embodiments, the hooks are configured to point inwardly and away from walls of the ear canal when the removal tool is inserted into the ear canal of the user this minimizes contact with canal walls. Also, at least a portion of the hooks can include an atraumtic coating, such as TEFLON or KAPTON. The hooks can also be configured to engage the loop structure without precise positioning of a particular hook with respect to the hearing device or the ear canal. This can be accomplished by configuring the hooks to be able to grab an attachment loop of the loop structure at multiple locations on the loop. The use of multiple hooks that engage the loops in multiple places also allows the user to engage the loop structure without direct visualization of the removal tool. Further, the hooks can be distributed or otherwise positioned to center the removal tool in the ear canal. In one embodiment, this can be accomplished by radially distributing at least three hooks equidistantly around the perimeter of an end portion of the shaft.

The hooks are desirably configured to define a gap between the hook and the shaft where the gap has a dimension configured to allow the hook to detachably engage a loop of the loop structure. In many embodiments, the hooks will have first and second portions where the second portion is shorter and coupled to the first at a retrograde angle, which can be in the range from 20 to 40 degrees and more preferably in the range of 26 to 30 degrees. Typically, an atraumatic coating will be applied to longer first portion but can applied to the second portion. Desirably, the hooks are configured to allow the loops to slide over the hooks including the shorter portion during insertion and removal of the removal tool. This facilitates sliding of the loop into the hook gap and to become engaged as well as sliding out to become disengaged. Slidability can be accomplished by the use of a lubricous coating, such as a flouropolymer, over all or a portion of the hook. In an embodiment this coating can be the same as the atraumatic coating.

In various embodiments, the loop structure can comprise a single loop or multiple loops which can lie in multiple planes, which allows the hooks or other attachment means to engage the loops in multiple planes. Desirably, the loop structure comprises a resilient polymer or metal and has sufficient flexibility and resilience to both deform and return to an original shape during the tool insertion process. Also the loop structure has sufficient pull strength to allow removal of the hearing aid by the removal tool, including embodiments where the loop structure has only a single loop.

In some embodiments, the removal tool can also include a magnet for wireless communication with a magnetically controllable switching means of the hearing aid such as reed switch used to control volume or put the hearing device into a sleep mode. The magnet can be embedded or otherwise coupled to an end portion of the removal tool. In alternative embodiments, the engagement elements themselves can actually comprise magnets and the attachment system a series of ferrous elements wherein the magnets have sufficient magnetic force to engage the ferrous attachment elements and pull the hearing device from the ear.

In an exemplary method of using the removal tool for removing a hearing device positioned in the ear canal, the hearing device user or another person inserts the removal tool into the user's ear canal until the hooks make contact with the loop structure and detachably engage the with the loop structure (or attachment system). This can be facilitated by withdrawing the tool slightly to set the hook in the loop and vica versa. Engagement can be accomplished independent of the radial orientation of the removal tool with respect to the hearing device since the hooks can engage the loops at multiple locations on the loop. Further, the hooks can engage a single loop or multiple loops in multiple planes so as to have multi-planer engagement and can engage the loops with no or only minimal application of axial force on the hearing device such that the device is not appreciably pushed back into the canal. After engagement, the tool is then withdrawn out of the ear removing the engaged hearing device. The hearing device is then detached from the tool. At any point during the removal process, the tool can be disengaged from the hearing device by slightly advancing the tool back into the ear canal to disengage the hooks. Insertion and removal are accomplished with minimal or no irritation or injury to the wall of the canal and can be done without visualization of the removal tool and minimal dexterity on the part of the user.

DETAILED DESCRIPTION OF THE INVENTION

Figure 1:
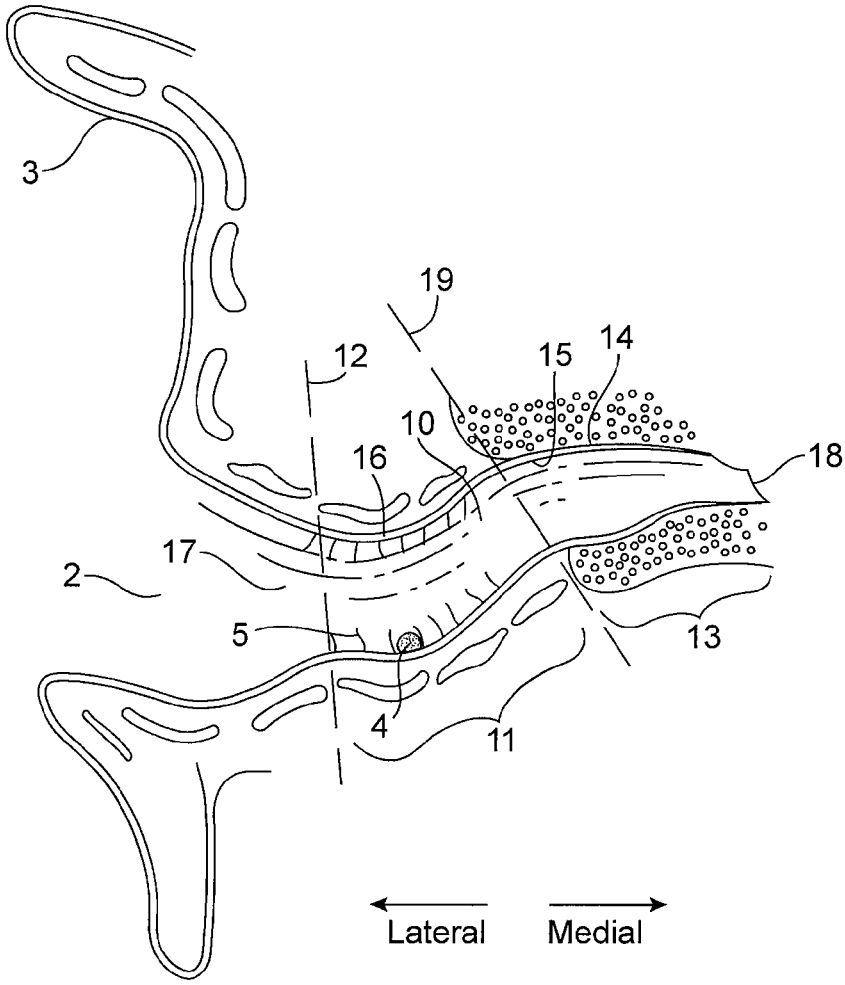
FIG. 1 is a side coronal view of the external ear canal.
Figure 2:
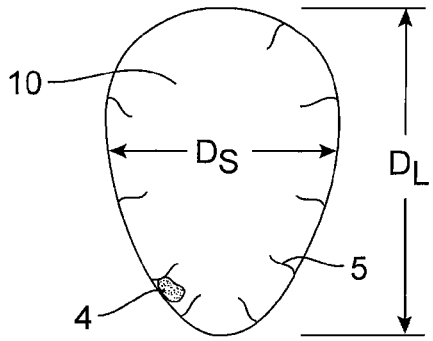
FIG. 2 is a cross-sectional view of the ear canal in the cartilaginous region.
Figure 3:
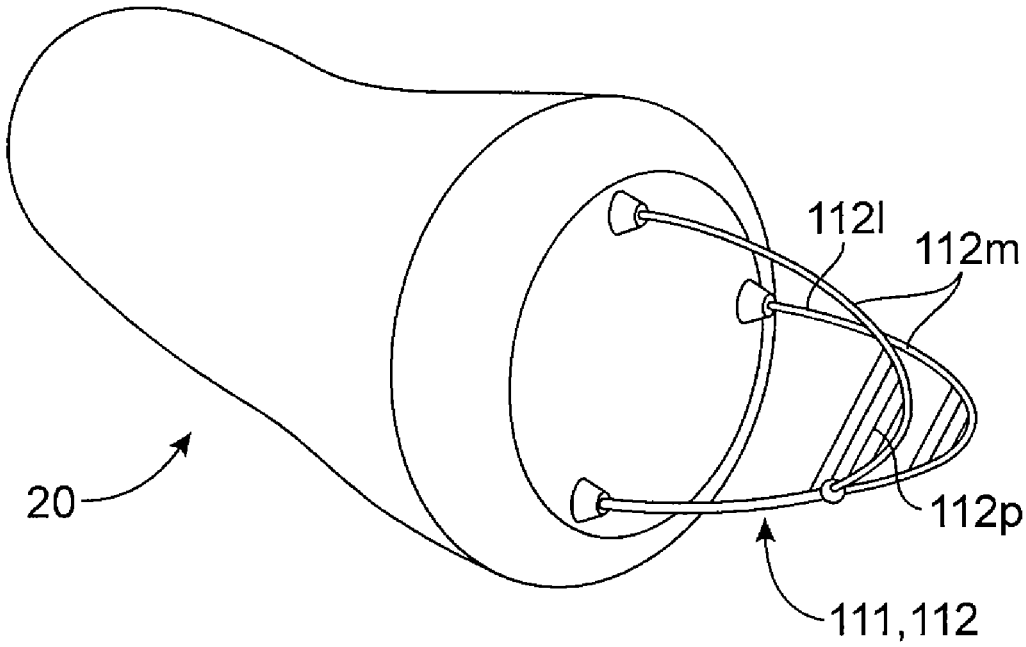
FIG. 3 is a perspective view illustrating an embodiment of a hearing aid device.
Figure 4:
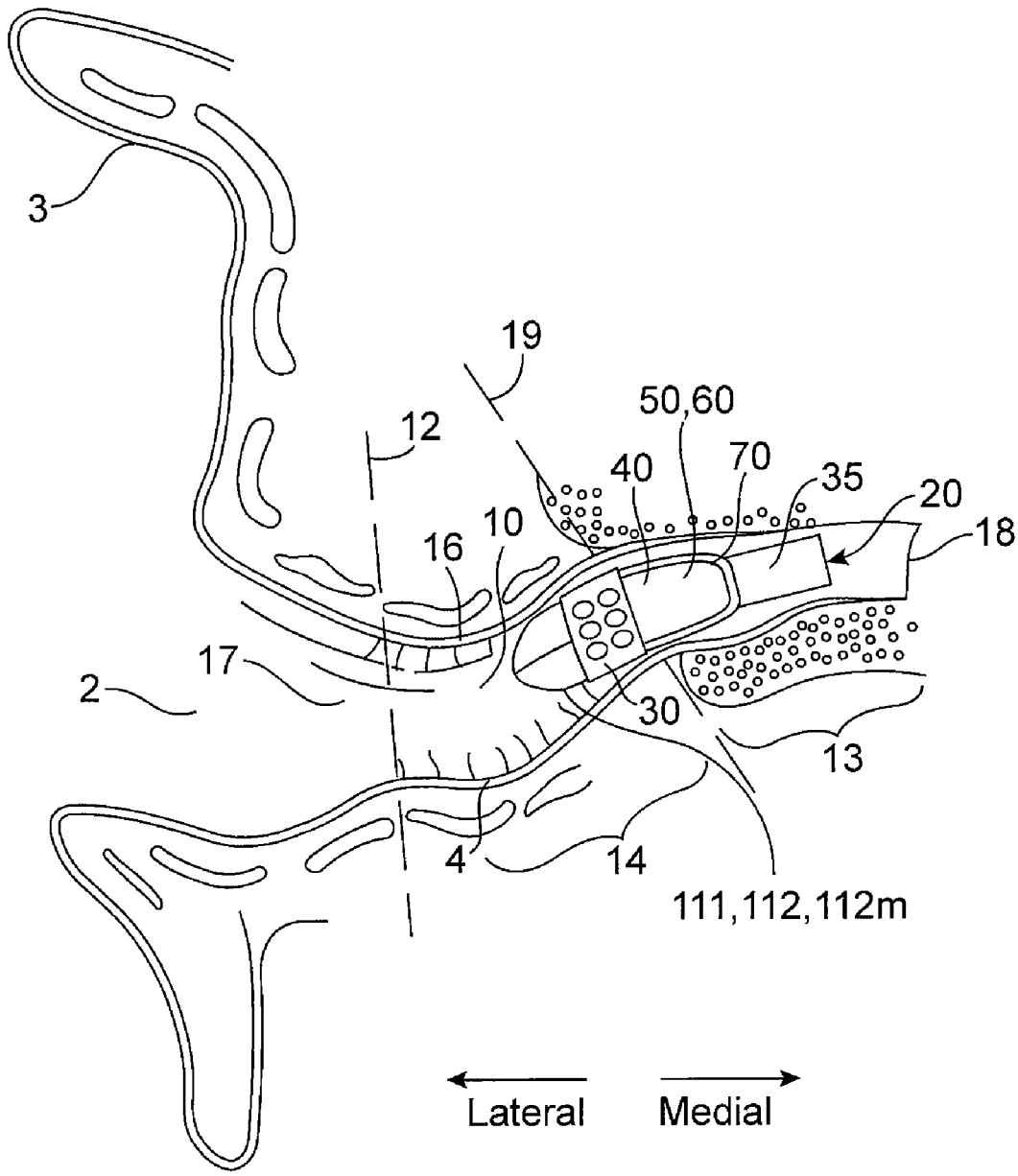
FIG. 4 is a cross-sectional view illustrating an embodiment of a hearing aid device positioned in the bony portion of the ear canal.

Referring now to FIGS. 3-8, various embodiments of the invention provide a removal tool 120 and a method for the removal of hearing devices using the tool. Such hearing devices can include extended wear, completely in the canal (CIC) hearing aids including those adapted to be positioned deep-in-the-canal (which are sometimes described as DITC devices). An embodiment of an extended wear CIC hearing aid 20 that can be positioned deep in to ear canal is shown FIGS. 3-4. CIC hearing aid 20 can include a microphone assembly 30, a receiver or speaker assembly 35 and a battery assembly 40 including a battery 50 contained in battery cavity 60 by an enclosure 70. Embodiments of hearing device 20 are described further in co-pending and commonly assigned U.S. patent application Ser. No. 11/053,456. However these and the illustrated embodiments of hearing device 20 are exemplary and in various embodiment removal tool 120 can be adapted for removal of a variety of INT and CIC hoaxing aids including deep-in-the-canal hearing devices.

Figure 5:
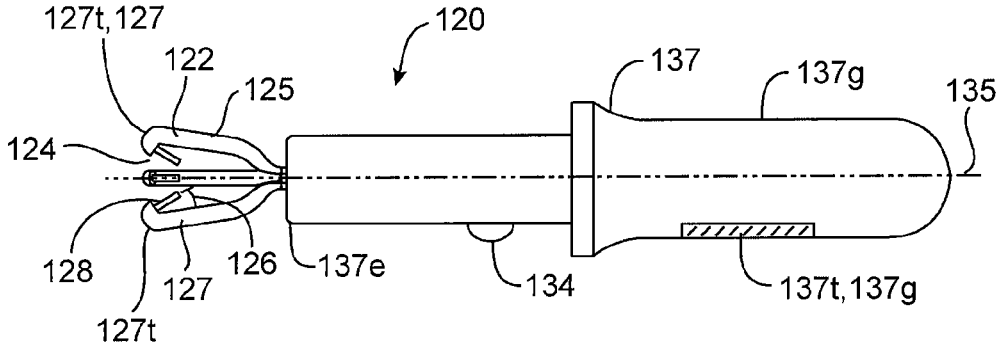
FIG. 5 is a lateral view illustrating an embodiment of a removal tool for removing a hearing device positioned deeply in the ear canal.
Figure 8:
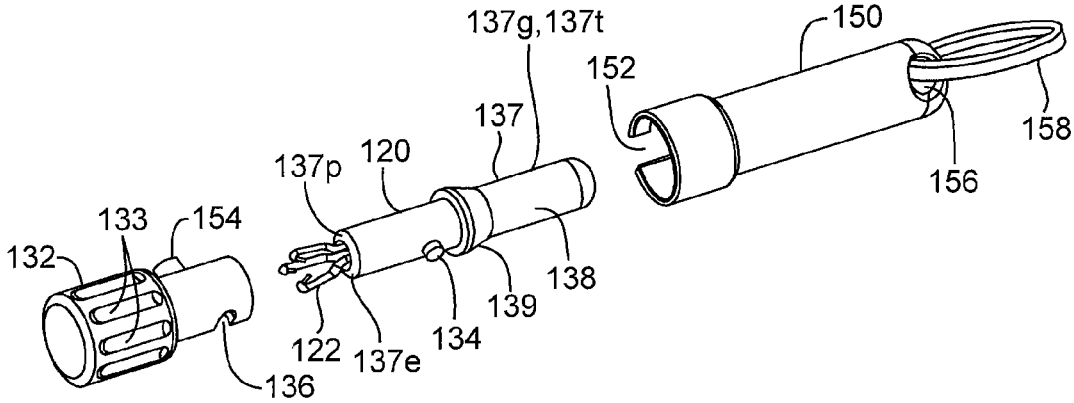
FIG. 8 is an exploded view illustrating an embodiment of a protective cap and housing for use with an embodiment of a removal tool for removing a hearing device positioned deeply in the ear canal.
Figure 6:
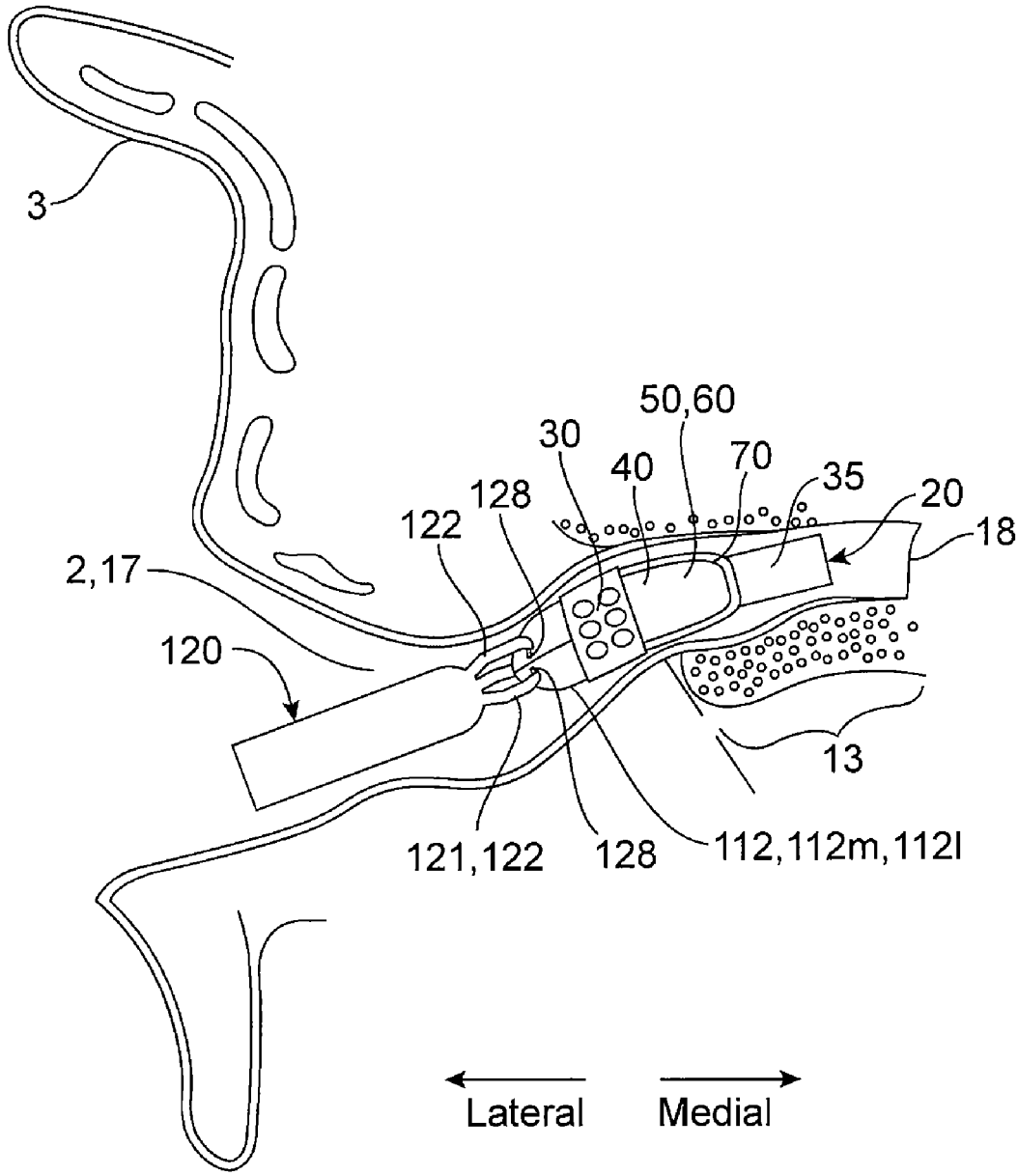
FIG. 6 is a cross-sectional view illustrating use of an embodiment of the removal tool for removing a hearing device positioned deeply in the ear canal.

An embodiment for removal tool for removal of a CIC device positioned deep in the ear canal is shown in FIGS. 5, 6 and 8. Removal tool 120 includes a shaft portion 137 configured to be grasp in the hand and one or more engagement elements 121 distributed around an end portion 137*e* of the shaft. Engagement elements 121 are configured to engage and attach to hearing aid 20 via an attachment system 111 that is coupled to hearing aid 20. More specifically, elements 121 can be configured to engage or mate with attachment system 111, though alternatively they can also be configured to attach to the hearing device directly. Desirably elements 121 are configured to detachably engage system 111, that is they can attach and then detach with system 111 through one or more mechanical motions. Elements can 121 can comprise pins, clamps, magnets or other mechanical or magnetic engagement means known in the art. In preferred embodiments, elements 121 comprise a plurality of thin hooks 122 positioned at a first end of a shaft 137 of removal tool 120. In such preferred embodiments, the hooks are desirably configured to detachably engage one or more loops of a loop structure which comprise an embodiment of attachment system 111 described below. In alternative embodiments the hooks can also be adapted to attach to an attachment system adapted for removable (e.g. pealable) cleaning layers adhered to the hearing device. In such embodiments, the attachment system can comprise a loop structure similar to embodiments described herein.

In various embodiments, the configuration, shape, orientation and other properties of the hooks can be configured to eliminate or other wise reduce injury or irritation to ear canal 10, and other parts of the ear as well, to facilitate removal of the hearing device. For example, in one embodiments the hooks 122 can be bent inwardly towards axis 135 of shaft 137 to minimize injury and/or irritation to the ear canal when the tool is inserted. Also, as is discussed herein, all or a portion of the hooks can have an atraumatic coating 125, such as TEFLON that is configured to minimize injury and irritation to the ear canals, in other words to make the hooks atraumatic. Further, the hooks can be sufficiently flexible (e.g. bendable) such that they at least partially bend if they should be inadvertently advanced into the canal walls during tool insertion. In use, embodiments of the removal tool having multiple inwardly bent atraumatic hooks provide a tool and method for a user to atraumatically remove their hearing aid.

Also the hooks are desirably be configured to allow the user to remove the hearing aid with minimal dexterity and without direct or minimal visualization of the removal tool or the ear. This can be accomplished through the use of a multi-planer loop system described herein and by configuring the hook to be able to grab an attachment loop structure at multiple locations on the loop. Such a configuration allows the hooks to engage the loop structure without precise positioning of a particular hook with respect to the hearing device or the ear canal. Further, by radialy distributing the loops around the perimeter 137*p* of an end portion of the shaft, the hooks can engage the loops structure independent of the radial orientation of the shaft with respect to the ear canal or the hearing device. The radial distribution of the hooks around the tool can also be configured to center the tool in the ear canal. In this way, the user, without any direct visual observation of the tool, or their own ear can insert the removal tool into the ear canal in any radial orientation and still engage and remove their hearing aid. In preferred embodiments for a self centering removal tool, the tool includes three or more hooks 122 that are equidistantly distributed around the perimeter 137*p* of an end portion 137*e* of shaft 137.

In various embodiments, the hooks 122 are bent at selectable angle 126 with respect to a longitudinal axis 135 of removal tool 120. In various embodiments, angle 126 is a retrograde angle with respect to hook 122 and can be about 20 to 40 degrees, more preferably about 25 to 35 degrees, most preferably about 26 is 30 degrees. In many embodiments, hooks 122 include a shorter leg 128 which is coupled to a tip portion 127*t* of longer leg 127 of the hook at a retrograde angle 126 to form a gap or space 124. Leg 128 can be formed by bending hook 122 using a fixture or other metal working tool or method known in the art. Gap 124 is configured to allow the passage of one or more loops 112L of a loop system 112 to allow the hook to engage and grab the loop. Also, as is described herein, leg 128 is configured to allow loops 112L to slide over leg 128 and into gap 124. Further, the removal hook is desirably sufficiently lubricous such that the removal tool does not engage and grab at the removal loops and remain fixed in an initial position at which it encounters the removal loops. This can be accomplished by the use of low friction and/or lubricous materials for construction of hooks 122 including leg 128 and/or the use of lubricous surface layers, or coating for hooks 122. For example, in one embodiment, leg 128 can be fabricated from a steel alloy that is polished (e.g., by electro-polishing, electroplating, etc.) to have a low friction surface.

In one embodiment, hooks 122 and loop system 112 are configured such that removal tool 120 can disengage from hearing device 20 after engagement, if so desired. If a subject that is wearing device 20 wishes to remove the device, but experiences pain or discomfort while doing so, removal tool 120 can be disengaged from hearing device 20 to halt the extraction process. This can be accomplished by slightly pushing the tool in the medial direction such that loops slide out from the hook. The subject can then seek assistance for subsequent removal of the hearing device by a second individual or a hearing care professional. Disengagement of removal tool 120 can be by the facilitated through configuration of hook gaps 124 and bend angle 126 to allow the loops to readily slide in an out of the hook to engage and disengage from the hook.

In various embodiments, hooks have selectable material and dimensional properties to facilitate canal insertion and engagement with the loop structure (or other attachment system) and subsequent removal of the hearing device for the ear canal. For example, the material used to fabricate hooks 122 can have sufficient flexibility and resilience for the hooks to both bend and substantially return to their original shape during the insertion process. More specifically, hooks 122 can have sufficient spring memory that they will substantially return to their original shape upon bending or other deformation. In preferred embodiments, the hook have sufficient flexibility to bend somewhat if they make contact with the ear canal wall during insertion, but with sufficient stiffness such that once they engage loops 112 they retain their shape to pull hearing device 20 out of the ear canal. Also the desirably material is relatively biocompatible and corrosion resistant. Suitable materials for hook 122 can include resilient plastics such as polycarbonates, polyethylenes or polyimides and non-corrosive resilient metals such as stainless steel, spring steel and shape memory alloys known in the art such as NITINOL. In embodiments using shape memory materials the hooks can be imparted with desired shape, using metallurgical methods known in the art.

In a preferred embodiment, the hooks are fabricated from 302 stainless steel available from Fort Wayne Metals in Michigan. In various embodiment, the hooks can have an outer diameter ranging from about 0.2 mm (0.010 in.) to about 0.75 mm (0.030 in.), preferably from about 0.3 mm (0.012 in.) to about 0.5 mm (0.020 in.), and most preferably from about 0.35 mm (0.014 in.) to about 0.45 mm (0.18 in.).

In various embodiment all or a portion of hooks 122 may include a coating 125 configured to provide protection to the ear canal from injury or irritation by the removal tool, as well as comfort to the person in whose ear the removal tool is being used. Desirably coating 125 is fabricated from a soft tissue atraumatic material known in the biomaterial arts. In specific embodiments the softness or durometer of the material is less than that of the epithelial tissue on the ear canals. Also desirably coating 125 is sufficiently lubricous to allow hooks 122 to slide over tissue in the ear and ear canal al well as allow loops 112L of removal system 112 to slide over the hooks including shorter leg 128. Coating 125 can cover all or a portion of leg 122. In one embodiment the coating covers long portion 127, but leave shorter leg portion 128 uncoated. In such embodiments, leg 128 can be given low frictional properties for the slidable engagement of loops 121 through the use of surface treatments such as polishing, or through the use of a thin liquid coating such as silicone oil In various embodiments coating 125 can be selected from silicones, polyimides and fluoro-polymers. Suitable fluoro-polymers include Teflon®, available from the DuPont® Corporation. Suitable polyimides include Kapton® also available from the DuPont® Corporation. In a preferred embodiment the coating comprises Kapton® a coating which is preferably applied to hooks before they are bent, and the stripped away after bending to expose all or a portion of leg portion 128. The coating can be applied using dip coating or spray coating methods known in the art or can also be applied as an adhesive tape coating.

In various embodiments, attachment system 111 can comprise any number of attachment means known in the art, e.g. clamps, catches, sockets, etc. In many embodiments, attachments system 111 is a loop system 112 (also called loop structure 112) comprised of one or more loops 112L that are configured to be engaged by hooks 122 (or other attachment elements 121) for removal of hearing aid 120 from the ear canal. Loop structure 112 has sufficient pull strength to allow removal of the hearing aid by the removal tool, this can include embodiments where the loop structure has only a single loop. Thus, in an embodiment, a single loop 112L has sufficient tensile strength (i.e. pull strength) to pull the hearing device out of ear canal 10. The tensile strength of loops 112L can be selected through selection of the materials and diameter of loop 112L. In various embodiments, the tensile strength of loop 112L can be in the range of about 0.1 lbs to 2 lbs of force, with specific embodiments of 0.25, 0.5 and 1 lbs of force.

The removal loops 112L are adapted to be able to slide freely along shorter legs 128 of removal hooks 122 into gap or space 124 between the hooks such that hooks 122 can properly engage the removal loop. Also, desirably the loops are configured to have a combination of flexibility, resilience and/or spring memory such that the loop will bend as its passes through gap 124 and then spring back against the leg portion 128 or other portion of hook 122 to be caught by the hook. In this way, the loop structure becomes mechanically engaged by the hooks.

In preferred embodiments, loop system 112 can comprise a lateral, multi-plane loop system 112*m*. Multi-plane system 112*m* is configured to allow hooks 122 to engage multiple loops 112L in multiple planes 112*p*. The multi-plane system also allows a given hook 122 to engage or grab any number of loops in multiple locations on the loop. These and related embodiments of a multi-plane loop system 112*m* allow hooks 122 to attach to the loop system and hearing device 20 without precise positioning of a given hook 122 with respect to the hearing aid 20 or ear canal 10. This in turn, allows a user to use the tool to remove a hearing device without visualization of the tool or ear and/or to do so with a minimal amount of dexterity. In various embodiment, loops 112L can lie in substantially orthogonal planes with respect to each other or other selectable angles.

Also in preferred embodiments, loop structure 112 and hooks 122 are configured such that the hooks engage the loops (i.e. the loops are caught by the hooks) with no or only minimal application of axial force on the hearing device such that the hearing device is not appreciably pushed back into the canal. This can be accomplished by one or more of the following configurations: i) configuring the hooks and/or the loops with low friction lubricous surfaces, such that the hooks easily slide over the loops, including leg portion 128 as is described herein; ii) selecting the loop material such that it bends under compression (i.e. it has a low compression modulus); and iii) configuring the size of gap 124 relative to the diameter of the loops such that the loop readily fits through the gap.

Figure 7:
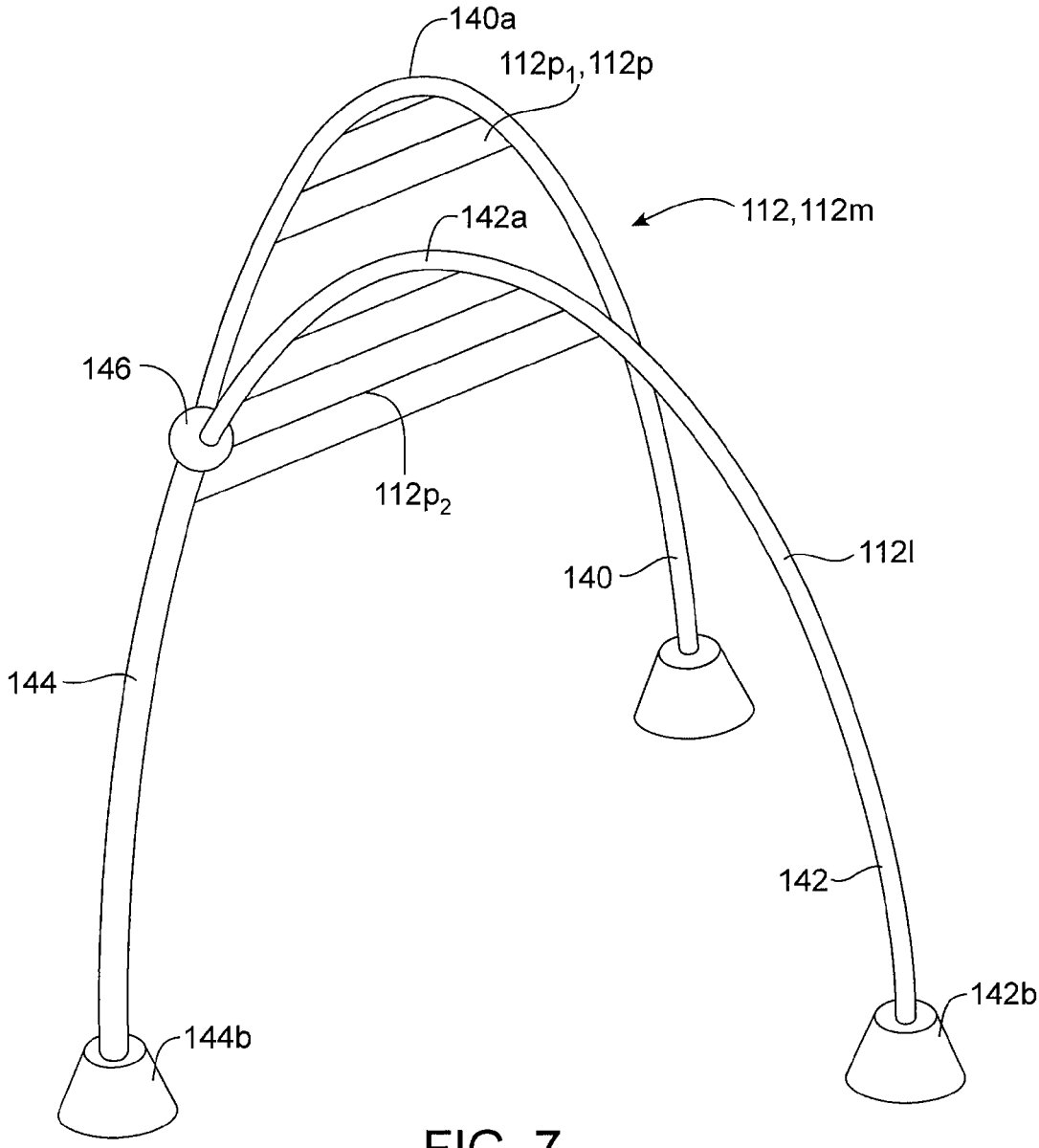
FIG. 7 is a perspective view illustrating an embodiment of a multi-plane loop system for use with an embodiment of a removal tool for removing a hearing device positioned deeply in the ear canal.

In one embodiment of a multi-plane loop system 112*p* shown in FIG. 7, loop system 112 comprises individual strands or legs 140 and 142 that join at knot 146 to form shorter leg or third strand 144. Leg 140 can lie in a first plane 112*p*1 and leg 142 can lie in second plane 112*p*2 which can be orthogonal to each other. In the embodiment shown, knot 146 is disposed on the loops at an offset position from the apexes 140*a* and 142*a* of legs 140 and 142 in to order eliminate the presence of a cumbersome ball or similar bulk at the end of the removal loop system 112 which might otherwise cause irritation to the ear canal of the wearer of the hearing device. This effect can be reduced by use of a lubricous coating for knot 146 and/or reducing the size of the knot. The offset shown is for purpose of illustration and other offsets are equally applicable. For example, knot 146 can be moved closer or farther from the base 142*b* or 144*b* of strands 142 or 144. Also, while only three strands or legs are shown in FIG. 7 it will be understood by those knowledgeable in the relative field that other numbers and combinations of removal loops 112L can also be contemplated. For example system 112, 112*p* could include 4, 5, 6 or even more loops.

In various embodiments, removal loop system 112 comprises a flexible resilient material, yet one that is sufficiently rigid to withstand significant displacement from its original shape. Suitable materials include resilient metals and polymers known in the arts including various suture materials known in the arts. Other desirable material properties for the loops 112L of loop system 112 include sufficient lubricity and/or softness (e.g., durometer) to be non irritating and/or atraumatic to the ear canals; sufficient lubricity to allow slidable movement of the hooks over the loops and sufficient strength (e.g. tensile strength) to facilitate removal of a deeply worn hearing device without breakage of the removal loops. Polyproplyene was found to meet these criteria and therefore in a preferred material removal, all or a portion of loops 121 are fabricated from polypropylene.

Referring now to FIGS. 5 and 8, in various embodiments, removal tool 120 may be provided with an optional cap or cover 132 in order to protect hooks 122 from being damaged during transportation or when the tool is not in use. An example of one such cap according to an embodiment of the present invention is shown in FIG. 8. Removal tool 120 is inserted into optional cap 132 until tab 134 engages partially hidden slot 136. With the proper twist lock configuration, tab 134 matingly engages slot 136 in order to lock removal tool 120 into cap 132. Either a soft click sound and/or the manual sensation that a gentle resistance has been overcome can signify to the user of the removal tool that the tool has mated with cap 132. Optional geographic features 133 of cap 132 include knurls—or, as depicted in FIG. 8, raised tabs—to provide greater handling convenience for the cap. This feature is especially beneficial for those who may be manually compromised or experience dexterity problems.

As is discussed herein, removal tool 120 includes a shaft 137 for convenience in using and grasping tool 120. All or a portion of shaft 137 can include a graspable portion 137*g*. Graspable portion 137*g* can include textured surface 137*t* or shaped grip to facilitate holding of the removal tool. Shaft 137 may also comprise an optional magnet 139 which can be housed in the shaft or housed within optional magnet cover 138 as is shown in Fig 8. Magnet 139 can be used, for example, for the remote or wireless configuration of a hearing device that incorporates control means capable of communication with a magnet. One such magnetically controllable device is the extended wear hearing device illustrated in FIG. 8. According to a preferred embodiment, removal tool 120 also comprises magnet 139 in order that the magnet is available in case it becomes necessary or desirable to controllably communicate with hearing device 20 without removal of the device from the ear canal of an individual wearing the device.

Referring now to FIG. 8, in various embodiments removal tool 120 may also comprise an optional housing or shield 150 for ease and convenience in transporting or carrying removal tool 120. When housing or shield 150 is comprised of a non-magnetizable metal it is further useful in preventing inadvertent demagnetization of devices or objects—such as credit cards—that one might carry on one's person in close proximity to the removal tool if optional magnet 139 is included in shaft 137.

With removal tool 120 inserted into cap 132 and locked into position such that tab 134 engages slot 136, housing 150 can be positioned about the removal tool until partially hidden slot 152 matingly engages tab 154 on cap 132. Again, with a twist lock manipulation, housing 150 becomes connected to cap 132 to provide a convenient holder or container for transporting removal tool 120 and magnet 139, while providing both components in easy access to a wearer or user of a hearing device. Optional hole 156 with optional key ring 158 positioned therethrough in housing 150 are included in FIG. 8 to illustrate one technique for carrying and keeping removal tool 120 readily at hand according to one embodiment of the present invention.

CONCLUSION

The foregoing description of various embodiments of the invention has been presented for purposes of illustration and description. It is not intended to limit the invention to the precise forms disclosed. Many modifications, variations and refinements will be apparent to practitioners skilled in the art. Further, the teachings of the invention have broad application in the hearing aid fields as well as other fields which will be recognized by practitioners skilled in the art. For example, the tool can also be adapted to remove other devices or objects in the ear such as ear plugs, hearing device cleaning layers and systems, etc.

Elements, characteristics, or acts from one embodiment can be readily recombined or substituted with one or more elements, characteristics or acts from other embodiments to form numerous additional embodiments within the scope of the invention. Hence, the scope of the present invention is not limited to the specifics of the exemplary embodiment, but is instead limited solely by the appended claims.

What is claimed is:

1. A removal tool for atraumatically removing a hearing device inserted deeply in the ear canal of a user, the removal tool comprising:

a shaft adapted to be grasped in the hand; and a plurality of hooks coupled to an end of the shaft; the hooks having a shape and orientation configured to minimize injurious contact with the walls of the ear canal when the removal tool is inserted into the ear canal and detachably engage a loop structure of the hearing device for removal of the device independent of a radial orientation of the shaft with respect to the hearing device.

2. The removal tool of claim 1, wherein the hooks are configured to engage the loop structure without precise positioning of a hook with respect to the hearing device or the ear canal.

3. The removal tool of claim 1, wherein the hooks are configured to point inwardly and away from walls of the ear canal when the removal tool is inserted into the ear canal of the user.

4. The removal tool of claim 1, wherein the hooks are configured to center the removal tool in the ear canal during insertion.

5. The removal tool of claim 1, wherein the hooks defines a gap between the hooks and the shaft, the gap has a dimension configured to allow the hooks to detachably engage a loop of the loop structure.

6. The removal tool of claim 1, wherein the hooks are configured to allow the user to engage the loop structure without direct visual observation of the removal tool.

7. The removal tool of claim 1, wherein the hooks are configured to slide over the loop structure during insertion of the removal tool.

8. The removal tool of claim 1, wherein the hooks are configured to allow the user to engage the loop structure without direct visual observation of the removal tool.

9. The removal tool of claim 1, wherein at least a portion of the loop structure comprises a resilient metal, a resilient polymer or polypropylene.

10. The removal tool of claim 1, wherein a single loop of the loop structure has sufficient pull strength to remove a hearing device positioned deeply in the ear canal.

11. The removal tool of claim 1, wherein the loop structure is a multi-plane loop structure and the hooks are configured for multi-planer engagement of the loop structure.

12. The removal tool of claim 1, wherein the shape of the hooks is a bent shape.

13. The removal tool of claim 1, wherein at least a portion of the hooks includes an atraumatic coating.

14. The removal tool of claim 13, wherein an end portion of the hooks is not coated.

15. The removal tool of claim 13, wherein the coating comprises a polymer, a lubricous polymer, a polyimide or a flouro-polymer.

16. The removal tool of claim 1, wherein a hook comprises a first portion and a second portion, the second portion coupled to the first portion at an inverted angle.

17. The removal tool of claim 1, further comprising a magnet coupled to the shaft, the magnet configured for remotely controlling the hearing device.

18. The removal tool of claim 17, wherein the hearing device comprises a switch selected from the group consisting of a magnetic switch and a reed switch.

19. The removal tool of claim 1, wherein the plurality of hooks includes three hooks.

20. A removal tool for atraumatically removing a hearing device inserted deeply in the ear canal of a user, the removal tool comprising:

a shaft adapted to be grasped in the hand; and a plurality of hooks coupled to an end of the shaft; the hooks having a shape and orientation configured to minimize injury to walls of the ear canal when the removal tool is inserted into the ear canal and detachably engaged to a loop structure of the hearing device in at least two planes for removal of the device.

21. A removal tool for atraumatically removing a hearing device inserted deeply in the ear canal of a user, the removal tool comprising:

a shaft adapted to be grasp in the hand; and a plurality of engagement elements coupled to an end of the shaft, the engagement elements having a shape and orientation configured to minimize injurious contact with the walls of the ear canal when the removal tool is inserted into the ear canal and detachably engaged to an attachment structure of the hearing device for removal of the device independent of a radial orientation of the shaft with respect to the hearing device.

22. The removal tool of claim 21, wherein the engagement elements are configured to center the removal tool in the ear canal during insertion.

23. The removal tool of claim 21, wherein the engagement elements are hooks.

24. The removal tool of claim 21, wherein the attachment structure is a loop structure.

25. The removal tool of claim 21, wherein an engagement element includes a magnetic and at least a portion of an attachment element comprises a ferrous material.

26. A CIC hearing device configured to be removed from deep in the ear canal by the removal tool of claim 21.

27. A removal tool for atraumatically removing a hearing device inserted deeply in the ear canal of a user, the removal tool comprising:

a shaft adapted to be grasped in the hand; and a plurality of engagement elements coupled to an end of the shaft; the engagement element having a shape and orientation configured to minimize injurious contact with the walls of the ear canal when the removal tool is inserted into the ear canal and engages an attachment structure of the hearing device for removal of the device while exerting minimal axial force on and causing no medial displacement of the hearing device when the removal tool is moved in a medial direction in the ear canal during engagement or removal.

28. A method for atraumatically removing a hearing device worn deeply in the ear canal of a user, the method comprising:

providing a hand held hearing device removal tool including a plurality of engagement elements, the engagement elements having a shape and orientation configured to minimize irritative contact with the walls of the ear canal;

inserting a portion of the hand held removal tool into the ear canal;

detachably engaging an attachment system coupled to the hearing device; with the engagement elements independent of a radial orientation of the tool with respect to hearing device; and withdrawing the removal tool from the ear canal with the hearing device attached thereto.

29. The method of claim 28, wherein the attachment system is engaged without precise positioning of an engagement element with respect to the hearing device or the ear canal.

30. The method of claim 28, wherein the engagement elements are configured to point inwardly and away from walls of the ear canal when the removal tool is inserted in to the ear canal of the user.

31. The method of claim 28, wherein the engagement elements are hooks.

32. The method of claim 31, wherein the plurality of hooks includes at least three hooks.

33. The method of claim 28, wherein the attachment system is a loop structure or a multi-planer loop structure.

34. The method of claim 28, wherein the engagement elements engage the attachment system in multiple planes.

35. The method of claim 28, wherein the engagement elements engage the attachment system without direct visualization by the user of the removal tool or the ear of the user.

36. The method of claim 28, wherein the engagement elements center the removal device in the ear canal.

37. The method of claim 28, further comprising detaching the engagement element from the attachment system.

38. The method of claim 28, wherein a non-user inserts the removal tool.

39. The method of claim 28, wherein a non-user removes the hearing device.

40. A method for atraumatically removing a hearing device worn deeply in the ear canal of a user, the method comprising:

providing a hand held hearing device removal tool including a plurality of engagement elements, the engagement elements having a shape and orientation configured to minimize irritative contact with the walls of the ear canal;

inserting a portion of the hand held removal tool into the ear canal;

engaging an attachment system coupled to the hearing device with the engagement elements; while exerting only minimal medial axial force on and causing no medial displacement of the hearing aid when the removal tool is moved in the medial direction in the ear canal, and withdrawing the removal tool from the ear canal with the hearing device attached thereto.

41. The method of claim 40, wherein the detachment system is engaged with only minimal displacement of the hearing device in the medial direction.

42. A removal tool for atraumatically removing a hearing device inserted deeply in the ear canal of a user, the removal tool comprising:

a shaft adapted to be grasp in the hand; and a plurality of engagement elements coupled to an end of the shaft, the engagement elements having a shape and orientation configured to minimize injurious contact with the walls of the ear canal when the removal to is inserted into the ear canal and detachably engage the hearing device independent of a radial orientation of the shaft with respect to the hearing device.

43. The removal tool of claim 42, wherein the engagement elements are hooks.

44. A removal tool for atraumatically removing a hearing device inserted deeply in the ear canal of a user, the removal tool comprising:

a shaft adapted to be grasp in the hand; and an engagement element coupled to an end of the shaft, the engagement element having a shape and orientation configured to minimize injurious contact with the walls of the ear canal when the removal tool is inserted into the ear canal and detachably engage an attachment structure of the hearing device for removal of the device independent of a radial orientation of the shaft with respect to the hearing device.

45. A removal tool for atraumatically removing a removable layer from a hearing device inserted deeply in the ear canal of a user, the removal tool comprising;

a shaft adapted to be grasp in the hand; and a plurality of engagement elements coupled to an end of the shaft, the engagement elements having a shape and orientation configured to minimize injurious contact with the walls of the ear canal when the removal tool is inserted into the ear canal and detachably engage an attachment structure of the removable layer for removal of the removable layer independent of a radial orientation of the shaft with respect to the hearing device.

46. A method for atraumatically removing a hearing device worn deeply in the ear canal of a user, the method comprising:

providing a hand held hearing device removal tool including at plurality of engagement elements;

inserting a portion of the hand held removal tool into the ear canal;

detachably engaging an attachment system coupled to the hearing device with the engagement elements independent of a radial orientation of the tool with respect to the hearing device; and withdrawing the removal tool from the ear canal with the hearing device attached thereto.

47. The method of claim 46, wherein the engagement elements detachably engage an attachment element coupled to the hearing device.

* * * * *